US011618996B2

(12) United States Patent
Afshari

(10) Patent No.: US 11,618,996 B2
(45) Date of Patent: Apr. 4, 2023

(54) FABRIC HAVING A CUT-RESISTANT COATING COMPRISING PARA-ARAMID PARTICLES

(71) Applicant: E I DU PONT DE NEMOURS AND COMPANY, Wilmington, DE (US)

(72) Inventor: Mehdi Afshari, Midlothian, VA (US)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 33 days.

(21) Appl. No.: 15/700,240

(22) Filed: Sep. 11, 2017

(65) Prior Publication Data

US 2018/0119335 A1 May 3, 2018

Related U.S. Application Data

(60) Provisional application No. 62/413,467, filed on Oct. 27, 2016.

(51) Int. Cl.

| | |
|---|---|
| ***D06M 15/564*** | (2006.01) |
| ***D06M 23/08*** | (2006.01) |
| ***D06N 3/10*** | (2006.01) |
| ***D06N 3/04*** | (2006.01) |
| ***D06N 3/14*** | (2006.01) |
| ***D06N 3/00*** | (2006.01) |
| ***A41D 19/015*** | (2006.01) |
| ***D06M 15/59*** | (2006.01) |
| ***A41D 31/24*** | (2019.01) |
| ***D02G 3/36*** | (2006.01) |
| ***D02G 3/44*** | (2006.01) |
| ***D06M 15/693*** | (2006.01) |
| ***D06M 101/16*** | (2006.01) |
| ***D06M 101/32*** | (2006.01) |
| ***D06M 101/34*** | (2006.01) |

(52) U.S. Cl.

CPC ..... *D06M 15/564* (2013.01); *A41D 19/01505* (2013.01); *A41D 31/245* (2019.02); *D02G 3/36* (2013.01); *D02G 3/442* (2013.01); *D06M 15/59* (2013.01); *D06M 15/693* (2013.01); *D06M 23/08* (2013.01); *D06N 3/0068* (2013.01); *D06N 3/045* (2013.01); *D06N 3/10* (2013.01); *D06N 3/14* (2013.01); *D06M 2101/16* (2013.01); *D06M 2101/32* (2013.01); *D06M 2101/34* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,063,966 | A | 11/1962 | Kwolek et al. | |
| 3,227,793 | A | 1/1966 | Cipriani | |
| 3,287,324 | A | 11/1966 | Sweeny | |
| 3,414,645 | A | 12/1968 | Morgan, Jr. | |
| 3,767,756 | A | 10/1973 | Blades | |
| 3,869,429 | A | 3/1975 | Blades | |
| 3,869,430 | A | 3/1975 | Blades | |
| 3,969,568 | A | 7/1976 | Sperley | |
| 4,308,374 | A | 12/1981 | Vollbracht et al. | |
| 4,994,323 | A | 2/1991 | Lee | |
| 5,114,652 | A | 5/1992 | Lee | |
| 5,525,700 | A | 6/1996 | Samuels et al. | |
| 5,667,743 | A | 9/1997 | Tai et al. | |
| 6,162,538 | A | 12/2000 | LaNieve et al. | |
| 6,712,681 | B1 * | 3/2004 | Chen | B24B 37/26 451/532 |
| 8,110,129 | B2 * | 2/2012 | Kurino | C08J 3/12 264/28 |
| 9,456,645 | B2 * | 10/2016 | Ghazaly | A41D 19/01505 |
| 10,086,498 | B2 * | 10/2018 | Regele | B24D 3/28 |
| 2005/0210584 | A1 * | 9/2005 | Lim | A47C 31/001 5/483 |
| 2016/0184970 | A1 * | 6/2016 | Labrecque | B24D 3/28 51/298 |
| 2016/0278458 | A1 * | 9/2016 | Howland | B32B 27/40 |

FOREIGN PATENT DOCUMENTS

| | | | |
|---|---|---|---|
| WO | 2012/149172 | A1 | 11/2012 |
| WO | 2012149172 | A1 | 11/2012 |
| WO | 2015/142340 | A1 | 9/2015 |
| WO | 2015142340 | A1 | 9/2015 |

OTHER PUBLICATIONS

PCT International Search Report, dated Dec. 8, 2017, for International Application No. PCT/US2017/051110, filed Sep. 12, 2017; ISA/EPO; Antonius Arkesteijn, Authorized Officer.

* cited by examiner

*Primary Examiner* — Lynda Salvatore

(57) ABSTRACT

A fabric comprising a cut-resistant polymeric coating including by weight 1 to 10 percent para-aramid particles, the particles having an average particle size of 20 to 500 microns.

9 Claims, No Drawings

FABRIC HAVING A CUT-RESISTANT COATING COMPRISING PARA-ARAMID PARTICLES

BACKGROUND OF THE INVENTION

Field of the Invention

This invention relates to a coating for fabrics that has surprisingly improved cut performance.

Description of Related Art

Cut-resistant articles including gloves having an elastomer coating are known. Further, articles having a coating including inorganic particles such as disclosed in PCT publications WO2015/142340 to Zhou et al., or WO2012/149172 to Ghazaly et al. are known.

Inorganic particles such as silica and various carbides are known to be hard materials and it is believed that when such materials are incorporated into a coating for a cut resistant article such as a glove, these inorganic particles pose a potential source of scratches to items being handled, such as finely finished parts like automotive hoods. Any feature that can improve the cut resistance of articles and that also reduce the potential for scratches is desirable.

BRIEF SUMMARY OF THE INVENTION

This invention relates to a fabric comprising a polymeric coating including by weight 1 to 10 percent para-aramid particles, the particles having an average particle size of 20 to 500 microns.

DETAILED DESCRIPTION OF THE INVENTION

This invention relates to a cut resistant fabric and/or article comprising a coating that includes para aramid cut resistance particles. The fabric can be made from fibers of para aramid, meta aramid, or a blend, and can include other fibers such as aliphatic polyamide (nylon), polyolefin, or polyester.

In some preferred embodiments, the cut resistant fabric is made from a para-aramid. In particular, para-aramid fiber such as Kevlar® brand para-aramid fiber available from E. I. du Pont de Nemours and Company, Wilmington, Del., is desired in fabrics and articles including gloves for its superior cut protection Surprisingly, it has been found that the addition of only one percent of para-aramid particles to the coating of such fabrics or articles provides a measurable improvement in cut resistance, generally 5 percent or greater improvement, preferably 10 percent improvement in cut resistance or greater. From a practical standpoint, the addition of up to about 10 percent para-aramid particles is desirable. Such higher amounts of para-aramid particles have shown improvements in cut resistance on the order of up to about 50%.

The average diameter of the particles can range from 20 to 500 microns (micrometers). In some embodiments the average diameter of the particles in this range is 50 microns or greater and in some other embodiments the average diameter of the particles in this range is 75 microns or greater. In some embodiments the average diameter of the particles in this range is 120 microns or greater. In some embodiments the average diameter of the particles in this range is 250 microns or less; in some embodiments the average diameter of the particles in this range is 120 microns or less. In some embodiments, the para-aramid particles are fibril-free and have a relatively low surface area. The individual particles are generally rounded in shape and by the term "fibril-free" it is meant they are without an appreciable number of fibrils or tentacles. It is believed that aramid particles dispersed substantially homogeneously throughout the coating provide, by virtue of the chemical composition of the particles, improved cut resistance to the coating and the article.

The particle constituent of the coating is about 1 to 10 percent by weight aramid particles. The most preferred para-aramid particles comprise poly(p-phenylene terephthalamide). Because they are substantially fibril-free, the aramid particles can provide uniform and agglomerate free coatings on the cut-resistant fabrics.

Para-aramid particles can be made by comminuting para-aramid polymer to the desired size. For example, para-aramid polymer made in accordance with the teachings in U.S. Pat. Nos. 3,063,966 and 4,308,374 is finished in the form of a water-wet crumb that can be dried and then pulverized in a hammer mill to an average diameter of 50 to 500 microns. Once dried and pulverized, the para-aramid particles can be classified and particles of the desired size range can be isolated for use.

Preferably, the aramid particles have a relatively low surface area, less than 2 to as little as 0.2 square meters per gram, which is indicative of the difference between high surface area pulp-like particles with fibrils and the fibril-free para-aramid particles. Pulp-like aramid particles with fibrils generally exhibit surface area greater than 5 square meters per gram, on the order of 10 square meters per gram. Surface area is determined by the B.E.T. method using nitrogen.

In some embodiments, the fabrics and articles as coated herein with para-aramid particles have even more benefits, including having cut resistance equivalent to or greater than a fabric made with commonly use 100% 1.5 denier per filament (1.7 dtex per filament) para-aramid fiber yarns. In other words, in some embodiments the cut resistance of a 100% para-aramid fiber fabric can be duplicated by a coated fabric having para-aramid particles but having lesser amounts of para-aramid fiber, meaning a fabric or article has equivalent performance at lower weight which translates to improved comfort in use.

As used herein, the word "fabric" is meant to include any woven, knitted, or non-woven layer structure or the like. The preferred fabrics are woven or knit fabrics made from yarn. By "yarn" is meant an assemblage of fibers spun or twisted together to form a continuous strand. As used herein, a yarn generally refers to what is known in the art as a singles yarn, which is the simplest strand of textile material suitable for such operations as weaving and knitting or it can mean a plied yarn. A spun staple yarn can be formed from staple fibers with more or less twist; a continuous multifilament yarn can be formed with or without twist. When twist is present in a singles yarn, it is all in the same direction. As used herein the phrases "ply yarn" and "plied yarn" can be used interchangeably and refer to two or more singles yarns twisted or plied together.

The yarn can comprise an intimate blend of staple fibers. By "intimate blend" it is meant the various staple fibers are distributed homogeneously in the staple yarn bundle. The staple fibers used in some embodiments have a length of 2 to 20 centimeters. The staple fibers can be spun into yarns using short-staple or cotton-based yarn systems, long-staple or woolen-based yarn systems, or stretch-broken yarn systems. In some embodiments the staple fiber cut length is preferably 3.5 to 6 centimeters, especially for staple to be used in cotton based spinning systems. In some other embodiments the staple fiber cut length is preferably 3.5 to 16 centimeters, especially for staple to be used in long staple or woolen based spinning systems. The individual staple fibers used in many embodiments have a diameter of 5 to 30 micrometers and a linear density in the range of about 0.5 to 6.5 denier per filament (0.56 to 7.2 dtex per filament), preferably in the range of 1.0 to 5.0 denier per filament (1.1 to 5.6 dtex per filament).

"Woven" is meant to include any fabric made by weaving; that is, interlacing or interweaving at least two yarns typically at right angles. Generally, such fabrics are made by interlacing one set of yarns, called warp yarns, with another set of yarns, called weft or fill yarns. The woven fabric can have essentially any weave, such as, plain weave, crowfoot weave, basket weave, satin weave, twill weave, unbalanced weaves, and the like. Plain weave is the most common. "Knitted" is meant to include a structure producible by interlocking a series of loops of one or more yarns by means of needles or wires, such as warp knits (e.g., tricot, milanese, or raschel) and weft knits (e.g., circular or flat). "Non-woven" is meant to include a network of fibers forming a flexible sheet material producible without weaving or knitting and held together by either (i) mechanical interlocking of at least some of the fibers, (ii) fusing at least some parts of some of the fibers, or (iii) bonding at least some of the fibers by use of a binder material. Non-woven fabrics that utilize yarns include primarily unidirectional fabrics, however other structures are possible.

In some preferred embodiments, the fabric is a knitted fabric, using any appropriate knit pattern and conventional knitting machines. Cut resistance and comfort are affected by tightness of the knit and that tightness can be adjusted to meet any specific need. A very effective combination of cut resistance and comfort has been found in for example, single jersey knit and terry knit patterns. In some embodiments, fabrics have a basis weight in the range of 3 to 30 oz/yd$^2$ (100 to 1000 g/m$^2$), preferably 5 to 25 oz/yd$^2$ (170 to 850 g/m$^2$), the fabrics at the high end of the basis weight range providing more cut protection The fabrics can be utilized in articles to provide cut protection. Useful articles include but are not limited to gloves, aprons, and sleeves. In one preferred embodiment the article is a cut resistant glove that is knitted, preferably knitted directly from spools of yarn.

In some embodiments aliphatic polyamide fiber refers to any type of fiber containing nylon polymer or copolymer. Nylons are long chain synthetic polyamides having recurring amide groups (—NH—CO—) as an integral part of the polymer chain, and two common examples of nylons are nylon 66, which is polyhexamethylenediamine adipamide, and nylon 6, which polycaprolactam. Other nylons can include nylon 11, which is made from 11-amino-undecanoic acid; and nylon 610, which is made from the condensation product of hexamethylenediamine and sebacic acid.

In some embodiments, polyolefin fiber refers to a fiber produced from polypropylene or polyethylene. Polypropylene is made from polymers or copolymers of propylene. One polypropylene fiber is commercially available under the trade name of Marvess® from Phillips Fibers. Polyethylene is made from polymers or copolymers of ethylene with at least 50 mole percent ethylene on the basis of 100 mole percent polymer and can be spun from a melt; however in some preferred embodiments the fibers are spun from a gel. Useful polyethylene fibers can be made from either high molecular weight polyethylene or ultra-high molecular weight polyethylene. High molecular weight polyethylene generally has a weight average molecular weight of greater than about 40,000. One high molecular weight melt-spun polyethylene fiber is commercially available from Fibervisions®; polyolefin fiber can also include a bicomponent fiber having various polyethylene and/or polypropylene sheath-core or side-by-side constructions. Commercially available ultra-high molecular weight polyethylene generally has a weight average molecular weight of about one million or greater. One ultra-high molecular weight polyethylene or extended chain polyethylene fiber can be generally prepared as discussed in U.S. Pat. No. 4,457,985. This type of gel-spun fiber is commercially available under the trade names of Dyneema® available from DSM and Toyobo and Spectra® available from Honeywell.

In some embodiments, polyester fiber refers to any type of synthetic polymer or copolymer composed of at least 85% by weight of an ester of dihydric alcohol and terephthalic acid. The polymer can be produced by the reaction of ethylene glycol and terephthalic acid or its derivatives. In some embodiments the preferred polyester is polyethylene terephthalate (PET). Polyester formulations may include a variety of comonomers, including diethylene glycol, cyclohexanedimethanol, poly(ethylene glycol), glutaric acid, azelaic acid, sebacic acid, isophthalic acid, and the like. In addition to these comonomers, branching agents like trimesic acid, pyromellitic acid, trimethylolpropane and trimethyloloethane, and pentaerythritol may be used. PET may be obtained by known polymerization techniques from either terephthalic acid or its lower alkyl esters (e.g., dimethyl terephthalate) and ethylene glycol or blends or mixtures of these. Useful polyesters can also include polyethylene napthalate (PEN). PEN may be obtained by known polymerization techniques from 2,6 napthalene dicarboxylic acid and ethylene glycol.

In some other embodiments the preferred polyesters are aromatic polyesters that exhibit thermotropic melt behavior. These include liquid crystalline or anisotropic melt polyesters such as available under the tradename of Vectran® available from Kuraray. In some other embodiments fully aromatic melt processible liquid crystalline polyester polymers having low melting points are preferred, such as those described in U.S. Pat. No. 5,525,700.

In some preferred embodiments, the fabric is made from aramid fiber, which can preferably be para-aramid fiber and/or meta-aramid fiber. The polymers can include polyamide homopolymers, copolymers, and mixtures thereof which are predominantly aromatic, wherein at least 85% of the amide (—CONH—) linkages are attached directly to two aromatic rings. The rings can be unsubstituted or substituted. Para-aramid fiber includes para-oriented synthetic aromatic polyamide polymers, while meta-aramid fiber includes meta-oriented synthetic aromatic polyamide polymers. That is, the polymers are para-aramid when the the two rings or radicals are para oriented with respect to each other along the molecular chain; the polymers are meta-aramid when the two rings or radicals are meta oriented with respect to each other along the molecular chain. Preferably polymers have no more than 10 percent of other diamines substituted for a primary diamine used in forming the polymer or no more than 10 percent of other diacid chlorides substituted for a primary diacid chloride used in forming the polymer.

In some embodiments, the preferred aramid fibers are para-aramid fibers. Poly(p-phenylene terephthalamide) (PPD-T) and copolymers thereof are preferred para-aramids. By PPD-T is meant the homopolymer resulting from molefor-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Para-aramid fibers are generally spun by extrusion of a solution of the para-aramid through a capillary into a coagulating bath. In the case of poly(p-phenylene terephthalamide), the solvent for the solution is generally concentrated sulfuric acid and the extrusion is generally through an air gap into a cold, aqueous, coagulating bath. Such processes are well known and are generally disclosed in U.S. Pat. Nos. 3,063,966; 3,767,756; 3,869,429, & 3,869,430. Para-aramid fibers are available commercially as Kevlar® brand fibers, which are available from E. I. du Pont de Nemours and Company, and Twaron® brand fibers, which are available from Teijin, Ltd.

The preferred meta-aramids are poly(meta-phenylene isophthalamide) (MPD-I) and its copolymers. One such meta-aramid fiber is Nomex® aramid fiber available from E. I. du Pont de Nemours and Company of Wilmington, Del., however, meta-aramid fibers are available in various styles under the trademarks Conex®, available from Teijin Ltd. of Tokyo, Japan, Apyeil®, available from Unitika, Ltd. of Osaka, Japan; New Star® Meta-aramid, available from Yantai Spandex Co. Ltd, of Shandong Province, China; and Chinfunex® Aramid 1313 available from Guangdong Charming Chemical Co. Ltd., of Xinhui in Guangdong, China. Meta-aramid fibers are inherently flame resistant and can be spun by dry or wet spinning using any number of processes; however, U.S. Pat. Nos. 3,063,966; 3,227,793; 3,287,324; 3,414,645; and 5,667,743 are illustrative of useful methods for making aramid fibers that could be used.

Any of the fibers discussed herein or other fibers combined with the fibers can be provided with color using conventional techniques well known in the art that are used to dye or pigment those fibers. Alternatively, many colored fibers can be obtained commercially from many different vendors. One representative method of making colored aramid fibers is disclosed in U.S. Pat. Nos. 5,114,652 and 4,994,323 to Lee. Any of the fibers discussed herein or other fibers combined with the fibers can be provided with reinforcing particles for improving cut resistance of other cut-promoting additives or fillers such as disclosed, for example, in U.S. Pat. No. 6,162,538 to LaNieve et al.

Useful polymeric compounds suitable for coating the fabric and articles include natural and synthetic rubbers, including but not limited to polyurethane elastomer, nitrile rubber, vinyl rubber, polyisoprene, neoprene, chloroprene, polychloroprene, acrylonitrile butadine, carboxylated acrylonitrile butadiene, styrene-butadiene, ethylene vinyl acetate, or some combination of these. In some embodiments the polymeric compounds include other materials having suitable elastic behavior to be coated and used on the surface of a fabric, such as fluorine containing polymers. Elastomeric material can be applied to the fabric as a latex, solution, melt, monomer-polymer mixture or any other form of liquid. A suitable mixture of the polymeric compound and the para-aramid particles is formed by mixing or compounding the para-aramid particles and the liquid polymeric compound until a uniform dispersion of the para-aramid particles in the polymeric compound is formed.

Fabrics and articles can be coated with the mixture of polymeric compound and para-aramid particles by such meaning as dipping the fabric or article into the mixture, solution or melt coating the mixture onto the surface of the fabric or article, spraying or blowing the mixture onto the surface of the fabric or article, or by application of a foam containing the mixture to the surface of the fabric or article.

Test Methods

Cut Resistance. The "Standard Test Method for Measuring Cut Resistance of Materials Used in Protective Clothing", ASTM Standard F 1790-97, was used to determine cut performance. In performance of the test, a cutting edge, under specified force, is drawn one time across a sample mounted on a mandrel. At several different forces, the distance drawn from initial contact to cut through is recorded and a graph is constructed of force as a function of distance to cut through. From the graph, the force is determined for cut through at a distance of 25 millimeters and is normalized to validate the consistency of the blade supply. The normalized force is reported as the cut resistance force.

The cutting edge is a stainless steel knife blade having a sharp edge 70 millimeters long. The blade supply is calibrated by using a load of 400 g on a neoprene calibration material at the beginning and end of the test. A new cutting edge is used for each cut test. The mandrel is a rounded electro-conductive bar with a radius of 38 millimeters and the sample is mounted thereto using double-face tape. The cutting edge is drawn across the fabric on the mandrel at a right angle with the longitudinal axis of the mandrel. Cut through is recorded when the cutting edge makes electrical contact with the mandrel.

Average Particle Size. A Coulter LS200 is used for measuring and determining particle size, distribution, and average particle size. The instrument uses the diffraction of laser light (750 nm) by the particles as the main source of information about particle size.

Example 1

Eight knitted fabric samples were made for coating trials using a plied staple-based 16/2's cotton count yarn (about 665 denier (760 dtex) total) of poly (paraphenylene terephthalamide) (PPD-T) fibers. Each of the knit fabric samples had a basis weight of 20 grams/square meter. Seven different coating mixtures were then made by mixing PPD-T resin particles with a polyurethane (Sancure® 2710 from Lubrizol). The PPD-T particles had an average particle size of either 120 and 500 micrometers. The amount of PPD-T resin particles mixed with polyurethane varied from 1 to 10 weight percent, based on the weight of the resin. The specific particles sizes and loadings are shown in the Table. One fabric sample used as a Control fabric was coated with just the polyurethane and no particles.

One side of the knit fabric was then hand coated by pouring an amount of the liquid resin with PPD-T particles onto the fabric surface and smoothing the coating with a squeegee. The coating was then cured on the fabric at room temperature overnight.

The cut performance of each coated fabric sample was then measured; the results are shown in the Table. Large increases in cut performance were found from adding just a few percent PPD-T resin particles to the coating.

Likewise, gloves can be coated by first knitting the glove from yarns and then dipping the gloves into the liquid resin containing the PPD-T particles and allowing the coating to cure or curing the coating, depending on the materials used.

TABLE

| Item | Particle Size, (μm) | Particle Loading, (wt %) | Cut Performance, (g) | Improvement, (%) |
|---|---|---|---|---|
| Control | NA | 0 | 1130 | NA |
| 1 | 500 | 1 | 1240 | 10 |
| 2 | 120 | 2 | 1230 | 9 |
| 3 | 500 | 2 | 1320 | 17 |
| 4 | 120 | 3 | 1240 | 10 |
| 5 | 500 | 3 | 1330 | 18 |
| 6 | 500 | 5 | 1570 | 39 |
| 7 | 120 | 10 | 1670 | 48 |

NA—Not Applicable

Example 2

Example 2 is repeated, but the PPD-T resin particles are mixed with a nitrile rubber coating rather than a polyurethane. The coating containing PPD-T particles provides a similar improvement as in Example 1 in cut resistance to the fabric.

What is claimed is:

1. A cut resistant article comprising a knit fabric comprising a polymeric coating on the surface of the fabric, the polymeric coating consisting of elastomeric material and 1 to 10 percent para-aramid particles by weight, the particles having an average particle size of 120 to 500 microns, wherein the article is a glove, apron, or sleeve.

2. The cut resistant article of claim 1 wherein the para-aramid particles are poly(praraphenylene terephthalamide) particles.

3. The cut resistant article of claim 1 wherein the fabric comprises yarns of para-aramid fibers, meta-aramid fibers, polyamide fibers, polypropylene fibers, polyethylene fibers, polyester fibers, or any mixture thereof.

4. The cut resistant article of claim 3 wherein the para-aramid fibers are poly(praraphenylene terephthalamide) fibers.

5. The cut resistant article of claim 1 wherein the elastomeric material is polyurethane elastomer, nitrile rubber, vinyl rubber, polyisoprene, neoprene, chloroprene, polychloroprene, acrylonitrile butadine, carboxylated acrylonitrile butadiene, styrene-butadiene, ethylene vinyl acetate, or some combination of these.

6. The cut resistant article of claim 5 wherein the elastomeric material is a polyurethane.

7. The cut resistant article of claim 5 wherein the elastomeric material is a nitrile rubber.

8. The cut resistant article of claim 1, wherein the fabric has a basis weight of 100 to 1000 grams per square meter (3 to 30 ounces per square yard).

9. The cut resistant article of claim 8, wherein the fabric has a basis weight of 170 to 850 grams per square meter (5 to 25 ounces per square yard).

* * * * *